US005653400A

United States Patent [19]

Narita et al.

[11] Patent Number: 5,653,400

[45] Date of Patent: Aug. 5, 1997

[54] WINDING APPARATUS

[75] Inventors: Keizo Narita, Fushimi-ku; Yasunari Kamikubo, Kusatsu; Masayuki Hatanaka, Kameoka, all of Japan

[73] Assignee: Nishimura Seisakusho Co., Ltd., Kyoto, Japan

[21] Appl. No.: 466,674

[22] Filed: Jun. 6, 1995

[30] Foreign Application Priority Data

Jan. 12, 1995 [JP] Japan ..... 7-021356

[51] Int. Cl.[6] ..... B65H 18/08; B65H 18/26

[52] U.S. Cl. ..... 242/530.4; 242/547

[58] Field of Search ..... 242/547, 530.1, 242/530.4

[56] References Cited

U.S. PATENT DOCUMENTS

| | | | |
|---|---|---|---|
| 1,853,384 | 4/1932 | Snow | 242/547 |
| 4,909,454 | 3/1990 | Welp et al. | 242/530.4 |
| 5,165,618 | 11/1992 | Ruff | 242/530.4 |
| 5,308,008 | 5/1994 | Rüegg | 242/541.7 |

FOREIGN PATENT DOCUMENTS

| | | | |
|---|---|---|---|
| 3832601 | 7/1989 | Germany . | |
| 358139945 | 8/1983 | Japan | 242/547 |
| 401145964 | 6/1989 | Japan | 242/547 |
| 402152847 | 6/1990 | Japan | 242/547 |
| 371912 | 6/1990 | Japan | 242/547 |
| 121350 | 4/1992 | Japan . | |
| 2097765 | 11/1992 | United Kingdom . | |

OTHER PUBLICATIONS

European Search Report dated Oct. 5, 1996.

*Primary Examiner*—John Q. Nguyen

*Attorney, Agent, or Firm*—Morgan & Finnegan, L.L.P.

[57] ABSTRACT

An apparatus for slitting a web material such as paper, plastic film and the like into a plurality of web materials and then winding the web materials to form a plurality of rolls, the rolls being divided into two groups, one group of rolls being arranged side by side and coaxially to each other at the front of the apparatus, the other group of rolls being arranged side by side and coaxially to each other at the rear of the apparatus. Tracking rollers are disposed on the upper side of one group of rolls and the upper side of the other group of rolls. Actuators press the tracking rollers against the corresponding groups of rolls with a contact pressure therebetween. One group of rolls and the other group of rolls are supported by carriages. Drives moves the carriages downwardly in response to the increases in diameters of the rolls to thereby enable the rolls to increase in diameters.

4 Claims, 4 Drawing Sheets

WINDING APPARATUS

FIELD OF THE INVENTION

The invention relates to an apparatus for winding a web material such as paper, plastic film and the like to form a roll. In particular, the invention relates to an apparatus for slitting the web material into a plurality of web materials and then winding the web materials to form a plurality of rolls.

PRIOR ART

There has been generally used an apparatus for slitting a web material such as paper, plastic film and the like into a plurality of web materials and then winding the web materials to form a plurality of rolls, as disclosed in Japanese Laid-Open Patent Publication No. 121350 of 1992. In the apparatus in the publication, the rolls are divided into two groups, one group of rolls being arranged side by side and coaxially to each other at the front of the apparatus, the other group of rolls being arranged side by side and coaxially to each other at the rear of the apparatus. The web materials are alternately directed to one group of rolls and the other group of rolls. The rolls each includes a core disposed between a pair of side plates. The side plates include chucking means for chucking the opposite ends of the cores. The chucking means are rotated integrally with the cores by motor means to wind the web materials about the cores to thereby form the rolls.

The apparatus includes tracking rollers disposed on the inner side of one group of rolls and the inner side of the other group of rolls. The tracking rollers are opposed to the corresponding groups of rolls horizontally. The web materials are directed to the rolls via the tracking rollers. Air or hydraulic cylinders press the tracking rollers against the corresponding groups of rolls with a contact pressure therebetween to conveniently wind the webs onto the rolls. The apparatus further includes two carriages, the tracking rollers and the cylinders for one group of rolls being supported by one carriage, the tracking rollers and the cylinders for the other group of rolls being supported by the other carriage. Motors rotate ball screws to move the carriages inwardly of the apparatus in response to the increases in diameters of the rolls to thereby enable the rolls to increase in diameters.

However, preparatory to winding, the operator is required to extend his hands from the outside of the apparatus to manually direct the web materials to the tracking rollers and the cores. The tracking rollers are positioned on the inner side of the cores which are disposed between the side plates. The cores and the side plates therefore obstruct the operator from directing the web materials to the tracking rollers and the cores. It takes labours and times. In addition, a large space is required in a horizontal direction in which the tracking rollers are opposed to the corresponding groups of rolls, and in which the carriages and the tracking rollers thereon are moved in response to the increases in diameters of the rolls. Furthermore, in order to move the carriages inwardly of the apparatus, two separate drive means such as the motors for rotating the ball screws are required to move the carriages in the opposite directions, involving a high cost.

SUMMARY OF THE INVENTION

It is therefore an object of the invention to provide a novel and improved apparatus for slitting a web material such as paper, plastic film and the line into a plurality of web materials and then winding the web materials to form a plurality of rolls, in which preparatory to winding, it is easy to manually direct the web materials to the rolls, a large space is not required in a horizontal direction, and the cost is reduced.

The gist of the invention lies in an apparatus for winding a web material such as paper, plastic film and the line to form a roll, which includes a tracking roller disposed not on the inner side of the roll but the upper side of the roll. An actuator presses the tracking roller against the roll with a contact pressure between the tracking roller and the roll. The roll is supported by a carriage. Drive means moves the carriage downwardly in response to the increase in diameter of the roll to thereby enable the roll to increase in diameter.

The tracking roller and the actuator may be supported by a carriage. In this case, drive means moves the carriage not downwardly but upwardly in response to the increases in diameter of the roll to thereby enable the roll to increase in diameter.

In the development of the invention, an improvement is applied to an apparatus for slitting a web material such as paper, plastic film and the like into a plurality of web materials and then winding the web materials to form a plurality of rolls, the rolls being divided into two groups, one group of rolls being arranged side by side and coaxially to each other at the front of the apparatus, the other group of rolls being arranged side by side and coaxially to each other at the rear of the apparatus. Tracking rollers are disposed on the upper side of one group of rolls and the upper side of the other group of rolls. Actuator means press the tracking rollers against the corresponding groups of rolls with a contact pressure therebetween. One group of rolls and the other group of rolls are supported by carriage means. Drive means moves the carriage means downwardly in response to the increases in diameters of the rolls to thereby enable the rolls to increase in diameters.

In a preferred embodiment, the carriage means comprises a common carriage for one group of rolls and the other group of rolls. The rolls each includes a core disposed between a pair of side plates which are attached to the carriage. The side plates include chucking means for chucking the opposite ends of the cores. The chucking means are rotated integrally with the cores to wind the web materials about the cores to thereby form the rolls. The carriage is mounted on a pillar for vertical movement. The drive means comprises a motor for rotating ball screw means extending along the pillar. The carriage includes nut member means fixedly attached thereto and engaged with the ball screw means to move the carriage along the pillar.

In other embodiment, the carriage means comprises two separate carriages, one group of rolls being supported by one carriage, the other group of rolls being supported by the other carriage. The carriages are mounted on pillars for vertical movement.

The tracking rollers and the actuator means may be supported by carriage means. In this case, drive means moves the carriage means not downwardly but upwardly in response to the increases in diameters of the rolls to thereby enable the rolls to increase in diameters.

In a preferred embodiment, the carriage means comprises a common carriage for the tracking rollers and the actuator means. The tracking rollers are mounted on levers for rotation respectively. The levers are mounted on the carriage for swinging movement. The actuator means comprises a plurality of air or hydraulic cylinders which are mounted on the carriage and operatively connected to the levers to press the tracking rollers against the rolls.

DESCRIPTION OF THE PREFERRED EMBODIMENT

Figure 1:
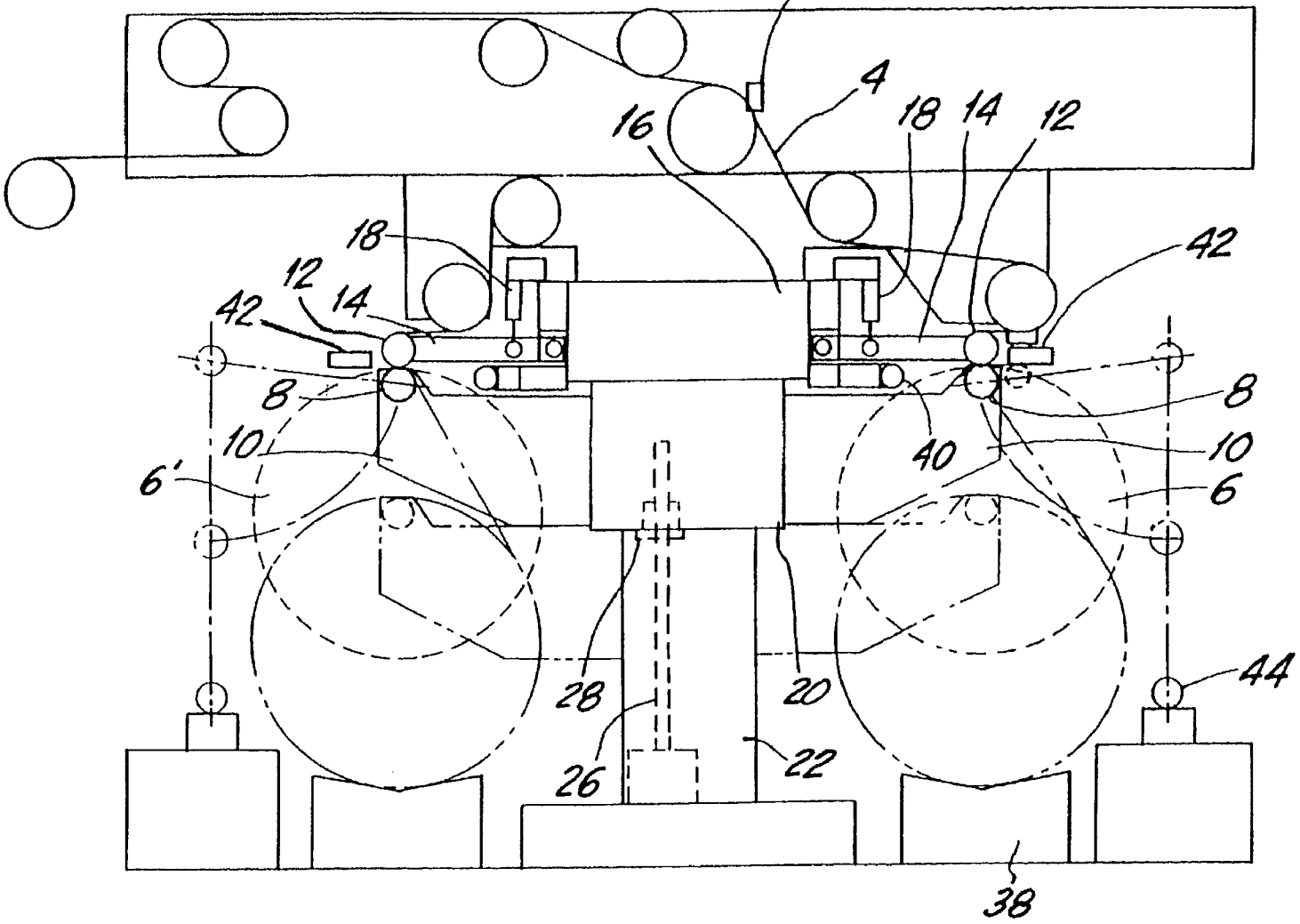
FIG. 1 is a side view of a preferred embodiment of the invention.

Referring to FIG. 1, an apparatus according to the invention is shown, which includes a plurality of slitting blades 2 for slitting a web material 4 such as paper, plastic film and the like into a plurality of web materials. The apparatus is intended to then wind the web materials 4 to form a plurality of rolls. The rolls are divided into two groups, one group of rolls 6 being arranged side by side and coaxially to each other at the front of the apparatus, the other group of rolls 6' being arranged side by side and coaxially to each other at the rear of the apparatus. The web materials 4 are alternately directed to one group of rolls 6 and the other group of rolls 6'.

The rolls 6 and 6' each includes a core 8 disposed between a pair of side plates 10. The side plates 10 include chucking means not shown for chucking the opposite ends of the cores 8. The chucking means are rotated integrally with the cores 8 by motor means not shown to wind the web materials 4 about the cores 8 to thereby form the rolls 6 and 6'.

Tracking rollers 12 are disposed on the upper side of one group of rolls 6 and the upper side of the other group of rolls 6' and mounted on levers 14 for rotation respectively. The levers 14 are mounted on a frame 16 for swinging movement. The tracking rollers 12 are opposed to the corresponding groups of rolls 6 and 6' vertically. The web materials 4 are directed to the rolls 6 and 6' via the tracking rollers 12.

The apparatus includes actuator means comprising a plurality of air or hydraulic cylinders 18 which are mounted on the frame 16 and operatively connected to the levers 14. The cylinders 18 cooperate with the levers 14 to press the tracking rollers 12 against the corresponding groups of rolls 6 and 6' with a contact pressure therebetween to conveniently wind the web materials 4 onto the rolls 6 and 6'.

Figure 2:
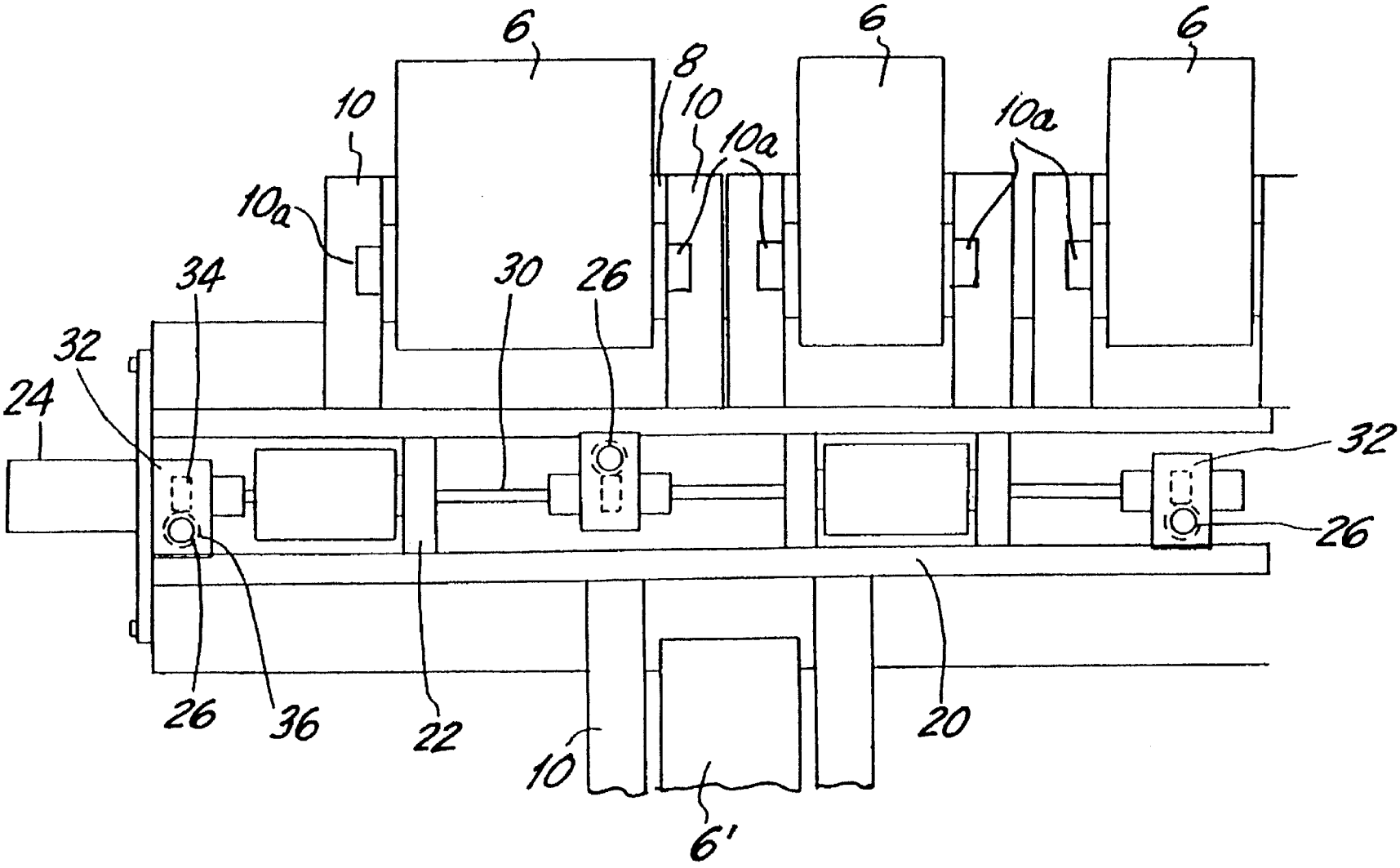
FIG. 2 is a plan view of drive means in FIG. 1.

The apparatus further includes carriage means comprising a common carriage 20 for one group of rolls 6 and the other group of rolls 6'. The side plates 10 are attached to the carriage 20 so that one group of rolls 6 and the other group of rolls 6' are supported by the carriage 20, as shown in FIG. 2. The carriage 20 is mounted on a pillar 22 for vertical movement.

The apparatus further includes drive means comprising a motor 24 for rotating ball screws 26 extending vertically and along the pillar 22. The carriage 20 includes nut members 28 fixedly attached thereto and engaged with the ball screws 26. The motor 24 is connected to a drive shaft 30 extending horizontally and supported by brackets 32 for rotation. The drive shaft 30 includes worms 34 attached thereto and received in the brackets 32. The ball screws 26 each includes a worm wheel 36 attached thereto, received in the bracket 32 and engaged with the worm 34. Accordingly, the ball screws 26 are rotated by the worms 34 and the worm wheels 36 when the drive shaft 30 is rotated by the motor 24 so that the carriage 20, the side plates 10 and the rolls 6 and 6' are moved vertically and along the pillar 22 by the ball screws 26 and the nut members 28.

A control unit not shown is provided to compute the increasing diameters of the rolls 6 and 6', and drive the motor 24 and control the speed thereof in response to the increases in diameters of the rolls 6 and 6'.

In addition, the apparatus includes roll lifters 38, cross cutters 40, web holders 42 and core feeders 44, which are known and therefore not explained in details herein.

In the apparatus, the rolls 6 and 6' increase in diameters more and more as the web materials 4 are wound. The control unit drives the motor 24 and controls the speed thereof so that the ball screws 26 and the nut members 28 move the carriage 20, the side plates 10 and the rolls 6 and 6' downwardly in response to the increases in diameters of the rolls 6 and 6'. This enables the rolls 6 and 6' to increase in diameters. The tracking rollers 12 are therefore held in position.

After winding, the control unit drives the motor 24 to move the carriage 20 downwardly a distance so that the rolls 6 and 6' are retracted and spaced from the tracking rollers 12. The cross cutters 40 are then moved toward the web materials 4 between the tracking rollers 12 and the rolls 6 and 6' to cut the web materials 4 widthwise. The leading ends of the web materials 4 are absorbed or adhered to the web holders 42. The lifters 38 are moved upwardly toward the rolls 6 and 6'. The rolls 6 and 6' are then released from the chucking means of the side plates 10 and supported on the lifters 38. The lifters 38 are then moved downwardly to take out the rolls 6 and 6'.

The cross cutters 40 are moved back to the position shown in FIG. 1. The carriage 20 are then moved upwardly to the position shown in FIG. 1. The cylinders 18 cooperate with the levers 14 to lift the tracking rollers 12 from the side plates 10. New cores are then fed by the core feeders 44 and chucked by the chucking means of the side plates 10. The cylinders 18 then lower and press the tracking rollers 12 against the web materials 4 on the cores. The chucking means is again rotated integrally with the cores to wind the web material 4.

Figure 3:
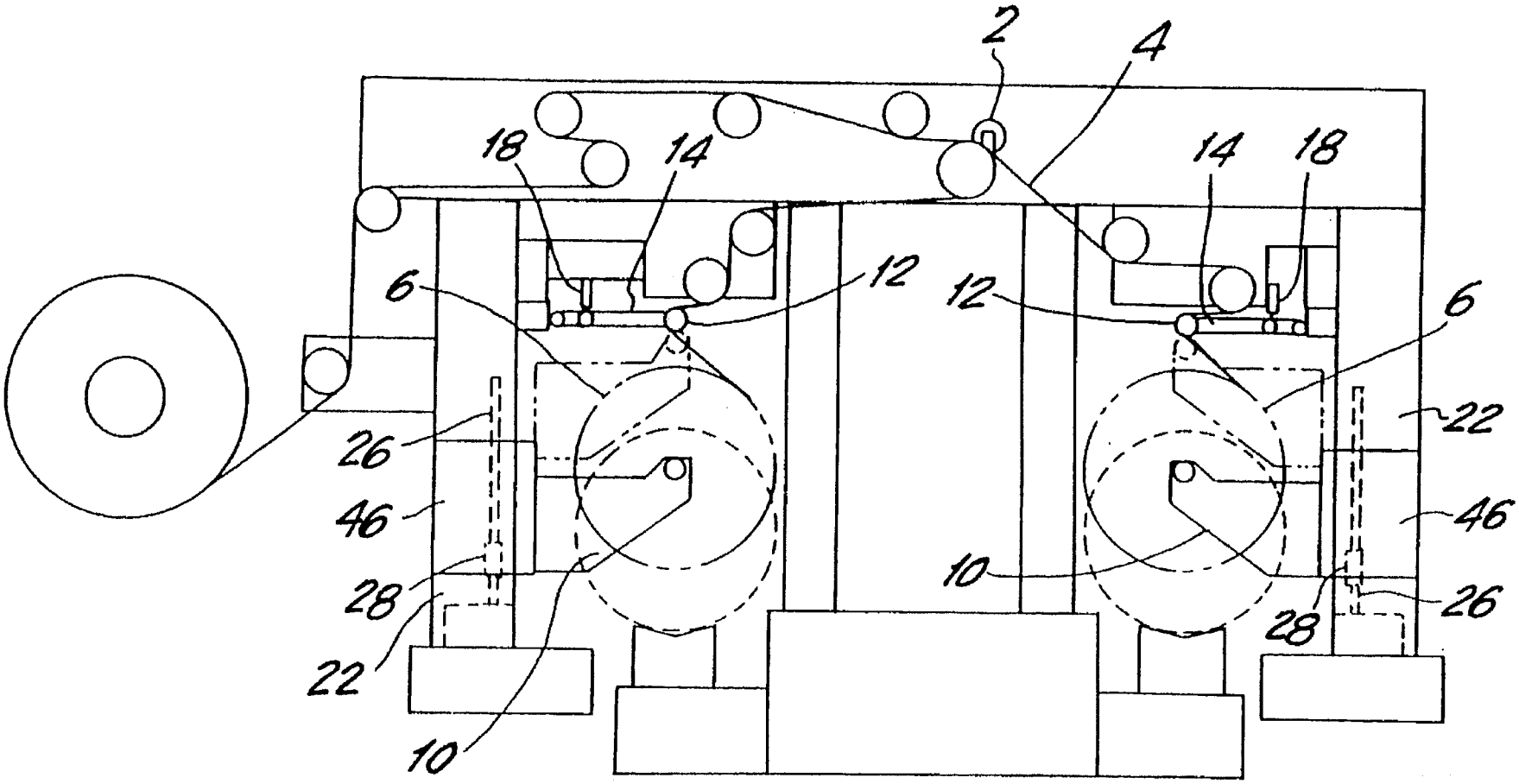
FIG. 3 is a side view of other embodiment of the invention.

In other embodiment shown in FIG. 3, the carriage means comprises two separate carriages 46 and 46'. The side plates 10 are attached to the carriages 46 and 46' so that one group of rolls 6 are supported by one carriage 46 and the other group of rolls 6' are supported by the other carriage 46'. The carriages 46 and 46' are mounted on pillars 22 for vertical movement. The carriages 46 and 46' each includes nut members 28 fixedly attached thereto and engaged with ball screws 26 which extend along the pillars 22 and rotated by a motor 24, as the apparatus in FIG. 1. The control unit drives the motor 24 and controls the speed thereof so that the ball screws 26 and the nut members 28 move the carriages 46 and 46' downwardly in response to the increases in diameters of the rolls 6 and 6' to thereby enable the rolls 6 and 6' to increase in diameters.

Figure 4:
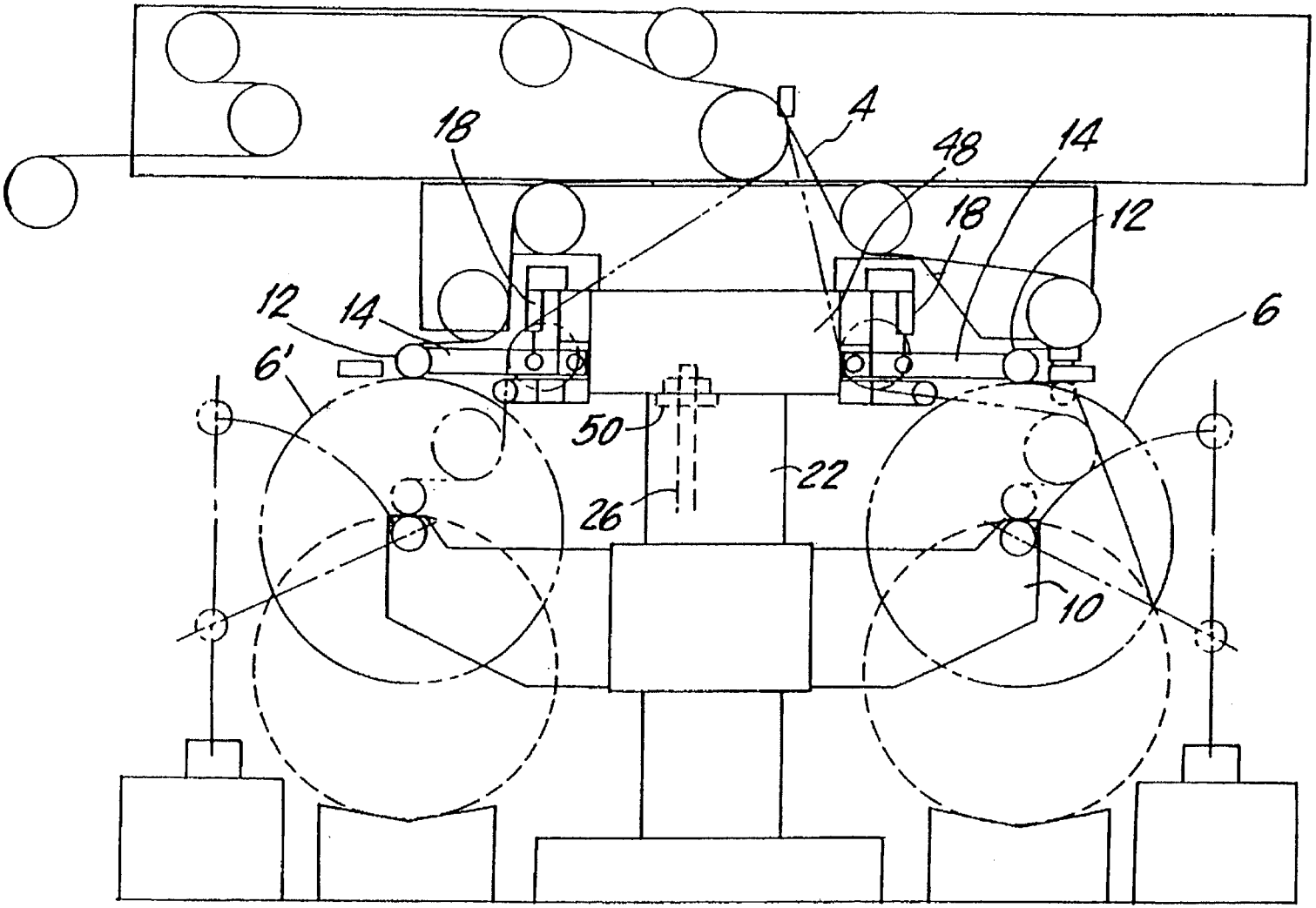
FIG. 4 is a side view of another embodiment of the invention.

In another embodiment shown in FIG. 4, the apparatus includes carriage means comprising a common carriage 48 for the tracking rollers 12 and the cylinders 18. The tracking rollers 12 are mounted on levers 14 for rotation respectively, the levers 14 being mounted on the carriage 48 for swinging movement. The cylinders 18 are mounted on the carriage 48 and operatively connected to the levers 14 so that the tracking rollers 12 and the cylinders 18 are supported by the carriage 48. The carriage 48 is mounted on the pillar 22 for vertical movement. The carriage 48 includes nut members 50 fixedly attached thereto and engaged with the ball screws 26 which extend along the pillar 22 and rotated by a motor 24, as the apparatus in FIG. 1.

In the apparatus in FIG. 4, the control unit drives the motor 24 and controls the speed thereof so that the ball screws 26 and the nut members 50 move the carriage 48, the tracking rollers 12 and the cylinders 18 upwardly in response to the increases in diameters of the rolls 6 and 6'. This enables the rolls 6 and 6' to increase in diameters. The rolls 6 and 6' are therefore held in position.

The carriage means may comprise two separate carriages, the tracking rollers 12 and the cylinders 18 for one group of rolls 6 being supported by one carriage, the tracking rollers 12 and the cylinders 18 for the other group of rolls 6' being supported by the other carriage.

In the above apparatuses, preparatory to winding, the operator extends his hands from the outside of the apparatus to manually direct the web materials 4 to the tracking rollers 12 and the cores 8. The tracking rollers 12 are positioned not on the inner side of the cores 8 but upper side thereof. It is therefore easy to manually direct the web materials 4 to the tracking rollers 12 and the cores 8 without obstruction. It does not take labours and times. In addition, a large space is not required in a horizontal direction since the tracking rollers 12 are opposed to the corresponding groups of rolls 6 and 6' not horizontally but vertically, the carriage means 20, 46, 46' or 48 being moved not horizontally but vertically. Furthermore, it has only to move the carriage means 20, 46, 46' or 48 downwardly or upwardly. A single drive means such as a motor 24 can be used therefor. Two separate drive means are not required. The cost is therefore reduced.

What is claimed is:

1. An apparatus for winding a web material to form a roll, comprising:

a tracking roller disposed on an upper side of said roll;

an actuator for pressing said tracking roller against said roll with a contact pressure between said tracking roller and said roll;

a carriage by which said roll is supported; and drive means for moving said carriage downwardly in response to an increase in diameter of said roll to thereby enable said roll to increase in diameter.

2. An apparatus for slitting a web material such as paper, plastic film and the like into a plurality of web materials and then winding the web materials to form a plurality of rolls, the rolls being divided into two groups, one group of rolls being arranged side by side and coaxially to each other at the front of the apparatus, the other group of rolls being arranged side by side and coaxially to each other at the rear of the apparatus, comprising:

tracking rollers disposed on an upper side of said one group of rolls and the upper side of the other group of rolls respectively;

actuator means for pressing said tracking rollers against the corresponding groups of rolls with a contact pressure therebetween;

carriage means by which said one group of rolls and the other group of rolls are supported; and drive means for moving said carriage means downwardly in response to increases in diameters of said rolls to thereby enable said rolls to increase in diameter.

3. An apparatus as set forth in claim 2, wherein said carriage means comprises two separate carriages, one group of rolls being supported by one carriage, the other group of rolls being supported by the other carriage, said rolls each including a core disposed between a pair of side plates which are attached to said carriages, said side plates including chucking means for chucking the opposite ends of said cores, said chucking means being rotated integrally with said cores to wind said web materials about said cores to thereby form the rolls, said carriages being mounted on pillars for vertical movement, said drive means comprising a motor for rotating ball screws extending along said pillars, said carriages each including nut member means fixedly attached thereto and engaged with said ball screws for moving said carriages along said pillars.

4. An apparatus as set forth in claim 2, wherein said carriage means comprises a common carriage for said one group of rolls and the other group of rolls, said rolls each including a core disposed between a pair of side plates which are attached to said carriage, said side plates including chucking means for chucking the opposite ends of said cores, said chucking means being rotated integrally with said cores to wind said web materials about said cores to thereby form the rolls, said carriage being mounted on a pillar for vertical movement, said drive means comprising a motor for rotating a ball screws extending along said pillar, said carriage including nut member means fixedly attached thereto and engaged with said ball screws for moving said carriage along said pillar.

* * * * *

UNITED STATES PATENT AND TRADEMARK OFFICE

CERTIFICATE OF CORRECTION

PATENT NO. : 5,653,400
DATED : August 5, 1997
INVENTOR(S) : Keizo Narita, et al

It is certified that error appears in the above-indentified patent and that said Letters Patent is hereby corrected as shown below:

On the title page:Item [54] and Column 1, line 1, delete the title "WINDING APPARATUS" and insert therefore the title -- APPARATUS FOR WINDING A WEB MATERIAL TO FORM A ROLL --.

IN THE SPECIFICATION:

At Column 1, line 66, delete the word "line" and insert therefor the word -- like --.

At Column 2, line 6, delete the word "line" and insert therefor the word -- like --.

Signed and Sealed this

Eleventh Day of November, 1997

*Attest:*

*Attesting Officer*

Bruce Lehman

BRUCE LEHMAN

*Commissioner of Patents and Trademarks*